US007475846B2

(12) United States Patent
Schroeder

(10) Patent No.: US 7,475,846 B2
(45) Date of Patent: Jan. 13, 2009

(54) FIN RETENTION AND DEPLOYMENT MECHANISM

(75) Inventor: Richard W. Schroeder, Healdsburg, CA (US)

(73) Assignee: General Dynamics Ordnance and Tactical Systems, Inc., St. Petersburg, FL (US)

( * ) Notice: Subject to any disclaimer, the term of this patent is extended or adjusted under 35 U.S.C. 154(b) by 214 days.

(21) Appl. No.: 11/243,323

(22) Filed: Oct. 5, 2005

(65) Prior Publication Data

US 2008/0001023 A1 Jan. 3, 2008

(51) Int. Cl.
*F42B 10/64* (2006.01)

(52) U.S. Cl. ..... 244/3.26

(58) Field of Classification Search ..... 244/3.24–3.29, 244/49

See application file for complete search history.

(56) References Cited

U.S. PATENT DOCUMENTS

| | | | | |
|---|---|---|---|---|
| 1,277,942 | A | 1/1918 | Kaylor | |
| 3,065,938 | A * | 11/1962 | Calkins | 244/46 |
| 3,861,627 | A * | 1/1975 | Schoffl | 244/3.27 |
| 4,163,534 | A | 8/1979 | Seeger | |
| 4,296,895 | A | 10/1981 | Pazmany | |
| 4,523,728 | A | 6/1985 | Frazer | |
| 4,565,340 | A | 1/1986 | Bains | |
| 4,892,253 | A | 1/1990 | Speicher et al. | |
| 5,379,968 | A | 1/1995 | Grosso | |
| 5,425,514 | A | 6/1995 | Grosso | |
| 5,452,864 | A | 9/1995 | Alford | |
| 5,505,408 | A | 4/1996 | Speicher et al. | |
| 5,630,564 | A | 5/1997 | Speicher et al. | |
| 5,647,558 | A | 7/1997 | Linick | |
| 5,662,290 | A | 9/1997 | Voigt | |
| 5,788,178 | A | 8/1998 | Barrett et al. | |
| 5,887,821 | A | 3/1999 | Voigt et al. | |
| 5,950,963 | A | 9/1999 | Speicher et al. | |
| 6,073,880 | A | 6/2000 | Voigt et al. | |
| 6,135,387 | A | 10/2000 | Seidel et al. | |
| 6,186,443 | B1 | 2/2001 | Shaffer | |
| 6,224,013 | B1 | 5/2001 | Chisolm | |
| 6,315,239 | B1 | 11/2001 | Voigt | |
| 6,446,906 | B1 | 9/2002 | Voigt et al. | |
| 6,460,446 | B1 | 10/2002 | Kathe | |
| 6,474,593 | B1 | 11/2002 | Lipeles et al. | |
| 6,581,871 | B2 | 6/2003 | Pijaca et al. | |
| 6,726,147 | B1 * | 4/2004 | Perini et al. | 244/3.27 |
| 6,727,485 | B2 | 4/2004 | Rastegar et al. | |
| 6,752,352 | B1 | 6/2004 | May et al. | |

(Continued)

FOREIGN PATENT DOCUMENTS

WO WO 2005/026654 A2 3/2005

*Primary Examiner*—Tien Dinh
(74) *Attorney, Agent, or Firm*—Shutts & Bowen, LLP; Joseph R. Englander

(57) ABSTRACT

A fin retention and deployment mechanism that has the advantage of providing for the deployment of aerodynamic control surfaces on command without the need for an additional actuation device or control circuitry separate from the actuator that controls the angle of the fins during flight. The actuator that is already required for operation of the control surfaces after deployment initiates the deployment of the fins, as well. A latch mechanism comprises a retaining member and a lath, which engages the retaining member enabling a biasing mechanism to force the fins from a stowed position to a fully deployed position.

12 Claims, 5 Drawing Sheets

U.S. PATENT DOCUMENTS

| | | | | |
|---|---|---|---|---|
| 6,880,780 | B1 * | 4/2005 | Perry et al. | 244/3.27 |
| 6,981,672 | B2 | 1/2006 | Clancy et al. | |
| 7,147,181 | B2 * | 12/2006 | Selin et al. | 244/3.27 |
| 2002/0190155 | A1 | 12/2002 | Lipeles et al. | |
| 2003/0047645 | A1 | 3/2003 | Rastegar et al. | |
| 2005/0115443 | A1 | 6/2005 | Rastegar et al. | |
| 2005/0133661 | A1 | 6/2005 | Rastegar et al. | |
| 2005/0133668 | A1 | 6/2005 | Rastegar et al. | |
| 2005/0150999 | A1 | 7/2005 | Ericson et al. | |

* cited by examiner

FIN RETENTION AND DEPLOYMENT MECHANISM

FIELD OF THE INVENTION

The field relates to deployment mechanisms for fins used in directional control of guided projectiles.

BACKGROUND

Existing actuators for fin control on gun-launched projectiles are known, but are both complex and expensive. The requirement to withstand the acceleration forces, which typically range from 10,000 to 30,000 times the force of gravity, places very stringent demands on the actuators. Therefore, the designs are required to be extremely robust in order to withstand the loads induced by these accelerations. Existing actuators for fin control on gun-launched projectiles typically employ electric motors to drive the fins through a gear reduction system. These motors are either brush or brushless types that make several revolutions of the motor while moving the fin from one travel limit to the other. In the case of the brush type motors, there are substantial reliability issues with the brush systems due to the high acceleration loads and problems with corrosion resulting from long-term storage. The brushless types have reliability issues with rotor position sensing complexity.

U.S. Pat. No. 6,752,352 discloses an actuator system for controlling the external fins on a gun-launched projectile to control the flight path of the projectile. The actuator system includes an electric motor having a rotor and output shaft which is driven between travel limits that are less than 180 apart (less than 90 in either direction from a central rest position). Coupling from the motor shaft to the control shaft for the external fins is via a coupling between an eccentric ball on the motor shaft and an eccentric receptacle member on the fin shaft. As the angle of the motor shaft varies, the eccentric ball slides in a slot in the fin coupling member, causing the fin shaft angle to vary correspondingly. In another embodiment, the eccentric ball for controlling the fin shaft angle is mounted on a link arm that is coupled to the motor shaft, thereby permitting the motor to be mounted off the projectile axis and thus accommodating a shortened space in the projectile required for the actuator system and associated power supply. U.S. Pat. No. 6,880,780 to Perry et al. discloses a fin cover release and deployment system for gun -launched missiles, which uses a pyrotechnic actuator to drive actuator arms or a motor and rotating threaded shaft. The motor and rotating threaded shaft requires the use of an additional cover eject spring, which is not necessary in the pyrotechnic actuator.

Known deployment mechanisms for extending the fins in flight add complexity and reduce reliability of the projectiles, especially when stored for extended durations. Typically, the deployment mechanisms are pyrotechnics. Alternatively, the fins are deployed by a mechanical interface with the launcher, such as being retained by the launch tube walls, a an ejectable cover or being deployed by a lanyard, which effectuate release of the fins from the stowed position at a preset distance from the launcher. Pyrotechnics may be unreliable if stored for extended durations. Mechanical mechanisms involving the launcher are known to introduce drag and airframe instabilities. Ejectable covers require additional cover release springs and add additional complexity.

SUMMARY OF THE INVENTION

A fin retention and deployment mechanism has the advantage of providing for the deployment of aerodynamic control surfaces on command without the need for an additional actuation device or control circuitry separate from the actuator that controls the angle of the fins during flight. The actuator that is already required for operation of the control surfaces after deployment initiates the deployment of the fins, as well. A latch mechanism comprises a retaining member and a latch, which engages the retaining member enabling a biasing mechanism to force the fins from a stowed position to a fully deployed position.

No separate cover is required to retain the fins, which eliminates the need for a separate cover retention or release system. Another advantage is that the housing is capable of supporting the shaft along a significant portion of its length. Previously known fin systems ordinarily required bearings on each output shaft to support the aerodynamic loading of the fins during flight. These bearing are costly, but required, due to the inherently short lengths of the shaft protruding into the projectile body of most known systems. In contrast, the present invention may use an elongated shaft that is supported over nearly the entire diameter of the projectile. Thus, the use of bearings is optional and costly bearings may be replaced by ordinary bushings or a slip fit between the shaft and housing support. Eliminating the bearings reduces cost of production and may reduce the packaging volume of the fin deployment and control mechanism.

The fins are retained in the stowed position by a latching mechanism, and any coupling of an actuator used for controlling the fins during flight that allows for relative rotational motion of a retaining member and a latch in a shaft may be used to free the retaining member from the latch. Once deployed, the fins may be attached to the shaft or fixed relative to the shaft by a latch and retaining member or any other locking or fixation element such that the fins rotate about the shaft axis with the shaft.

DETAILED DESCRIPTION OF PREFERRED EMBODIMENTS OF THE INVENTION

This detailed description and drawings provide specific examples of the invention, but the invention should not be limited merely to the examples disclosed. Instead, the invention should be limited only by the claims that may eventually issue. Many variations in the system, changes in specific components of the system and uses of the system will be readily apparent to those familiar with the field based on the drawings and description provided.

As used herein, the term "projectile" refers to any launched object regardless of the object's purpose or method of propulsion. This description generally utilizes gun-launched projectiles as an appropriate example of the invention. However, other potential projectiles are contemplated and would be obvious to one of ordinary skill in the art. Examples include, but are not limited to, missiles, rockets, torpedoes, shells, rounds, and bullets.

As used in this application the term "fin" refers to any projection extending from the projectile body and having an aerodynamic control surface. The shape and configuration of the fin are not limited to the embodiments illustrated or described herein.

Figure 1:
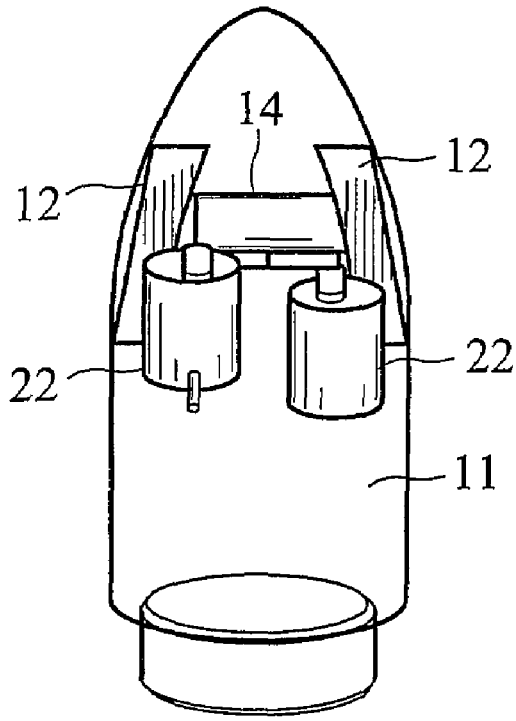
FIG. 1 illustrates an example with the fins stowed.
Figure 2:
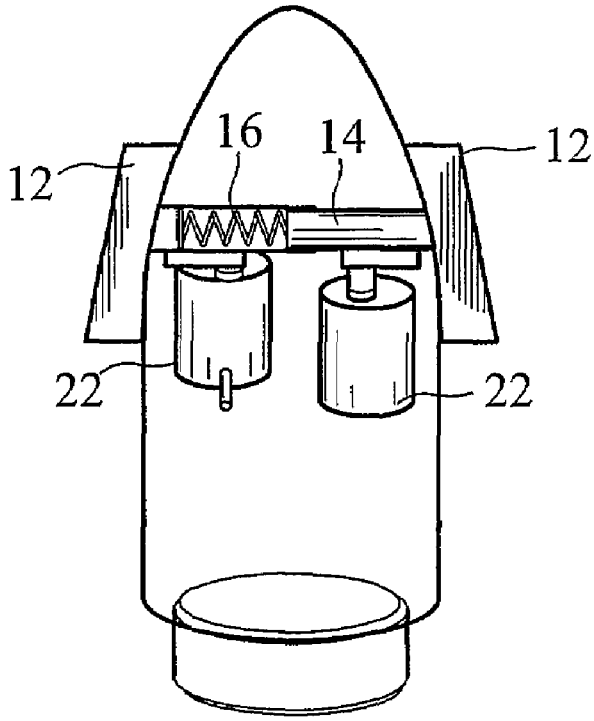
FIG. 2 illustrates an example of a mechanism and telescoping shaft showing a semi-transparent outer shaft supporting an inner shaft and fin deployment mechanism in order to better illustrate the mechanism.

In one embodiment of the invention, as shown in FIGS. 1-3C, two fins 12 are mounted on opposite ends of a telescoping shaft 14. A biasing mechanism 16 deploys the fins 12 from the stowed position, as shown in FIG. 1, to the fully deployed position, as shown in FIG. 2. A telescoping shaft 14 may allow for independent rotation of the fins 12 about the shaft's longitudinal axis. The telescoping shaft 14 also provides a volume for storing the energy required to deploy the fins 14 outwardly through the shell 11 of the projectile body. For example, a biasing mechanism 16, such as a spring, may be inserted in a cavity formed by annular walls 17 of the telescoping shaft 14.

Figure 3A:
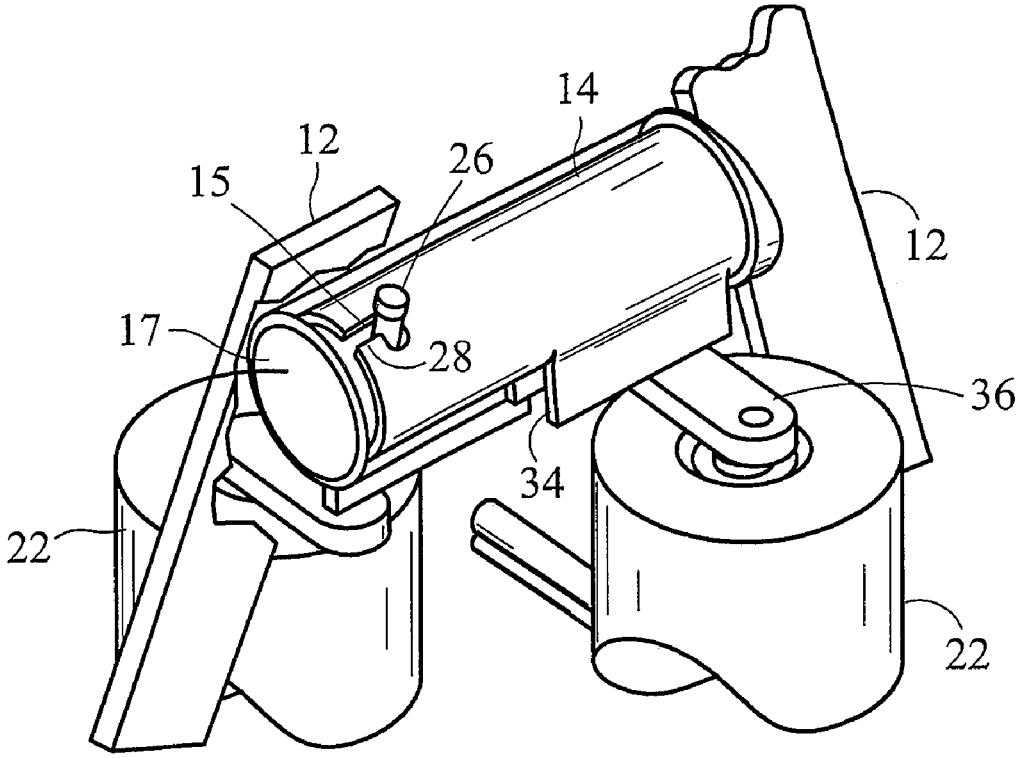
FIGS. 3A-3C illustrate a locking mechanism coupled to a drive mechanism in the (A) locked position, (B) unlocked position, and (C) deployed position.

The shaft 14 may have a latching mechanism 15 that secures the fins 12 in the stowed position, as shown in FIG. 3A. One portion of the telescoping shaft 14 in FIGS. 2 is cut away to reveal the biasing mechanism 16 that causes the extension of the telescoping shaft 14 for illustration purposes.

Figure 3B:
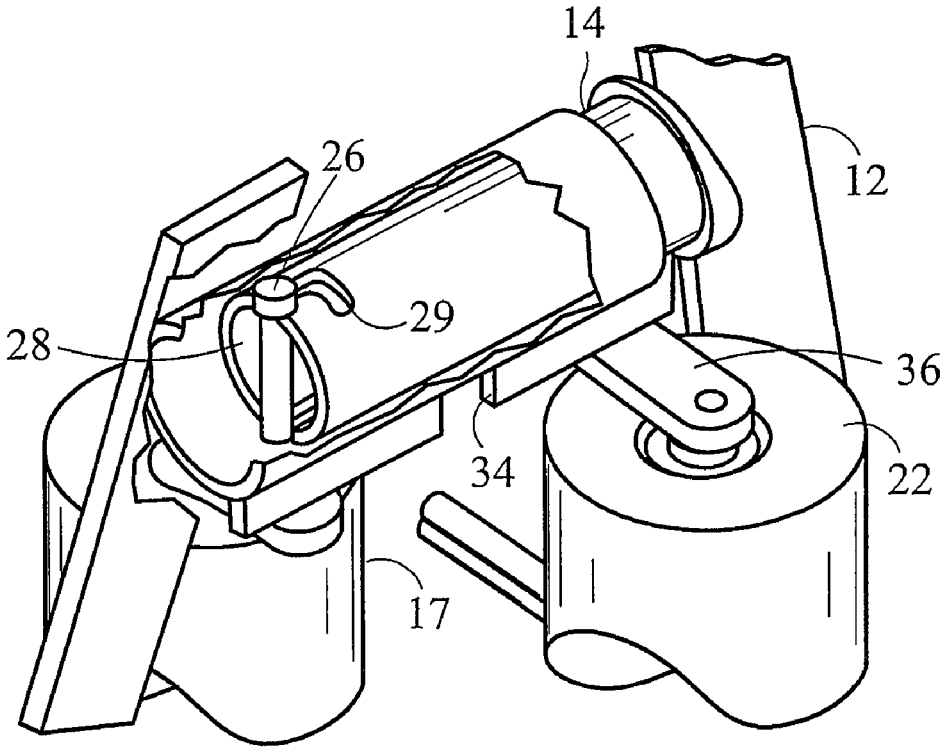

The fin retention and deployment mechanism of the example shown in FIGS. 1 and 2 may be coupled with the drive mechanism described in U.S. Pat. No. 6,752,352, which is incorporated herein by reference in its entirety. Alternatively, the mechanism may be coupled with any other compatible drive mechanism 22, which permits the drive mechanism 22 to be used for rotating the shaft 14 from a latched position, as shown in FIG. 3A, to an unlatched position, as shown in FIG. 3B.

Figure 3C:
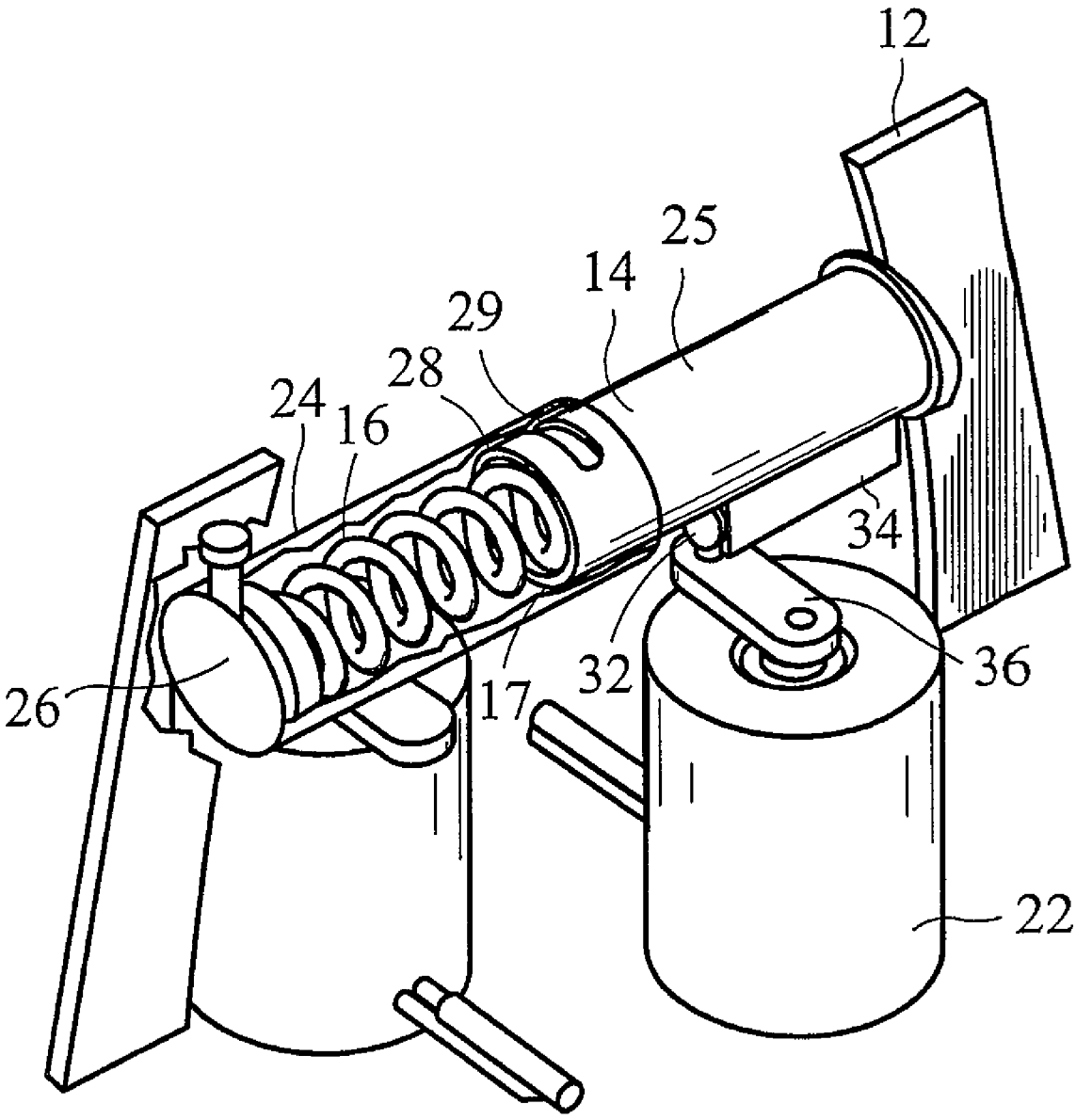

The telescoping shaft 14 has a first tube 24 and a second tube 25 that is dimensioned to fit within the first tube 24 and a biasing mechanism 16 disposed within the second tube 25, which applies an axial, outward force between the first tube 24 and the second tube 25, which acts to extend, telescopically, the shaft 14 to the fully deployed position shown in FIG. 3C. A pin 26 attached to either of the tubes 24,25 is inserted in a slot 28 formed in the other tube. The slot 28 has latch 29. The pin 26 is positioned in the latch 29, when the shaft 14 is held in the latched, stowed position by the actuator mechanism 22. Rotation of one tube relative to the other tube unlatches the pin 26 from the latch 29, as shown in FIG. 3B, allowing the tubes to extend under the force applied by the biasing mechanism to the fully deployed position, as shown in FIG. 3C.

When fully deployed, the ball 32 of the actuator mechanism 22 is capable of engaging a channel 34 coupled to the fin 12 by the tube 25. The rotational motion of a member 36 of the actuator mechanism 22 engages the ball 32 in the channel 34 causing rotational motion of the tube 25. The rotational motion of the tube 25, which is coupled to the fin 12, causes rotation of the fin 12 about the rotational axis of the tube 25. Prior to deployment, the same mechanism is capable of rotating tube 25 to disengage the pin 26 from the latch 29, as shown in FIGS. 3A and 3B.

Combining the latching mechanism 15 with the actuating mechanism 22 saves space by using the servo motors and drive mechanism required for rotation of the fins 12 during flight to actuate the unlatching of the fin latch mechanism 15. This reduces volume, complexity and part count by eliminating a separate actuating device for unlatching the fins 12.

Figure 4:
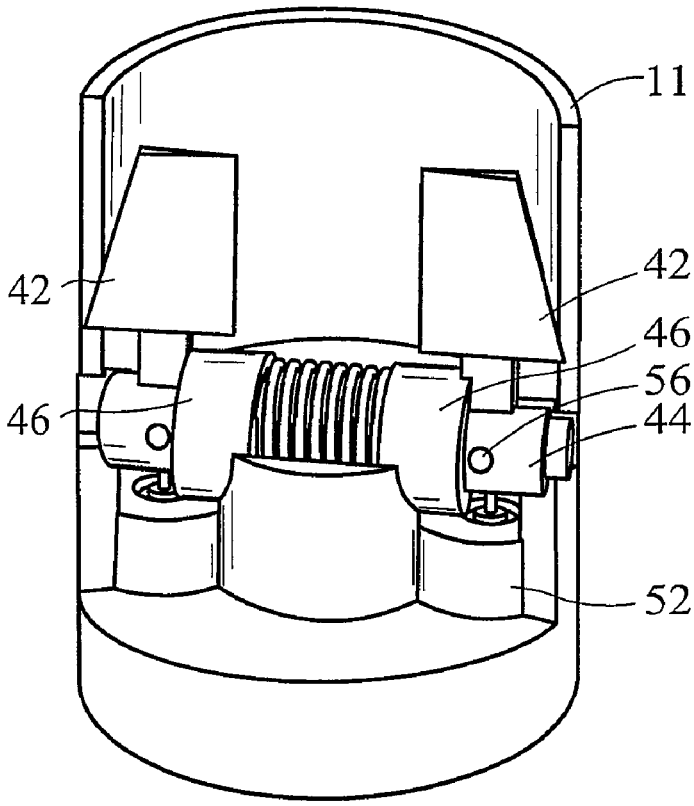
FIG. 4 illustrates another embodiment in the stowed position.
Figure 5:
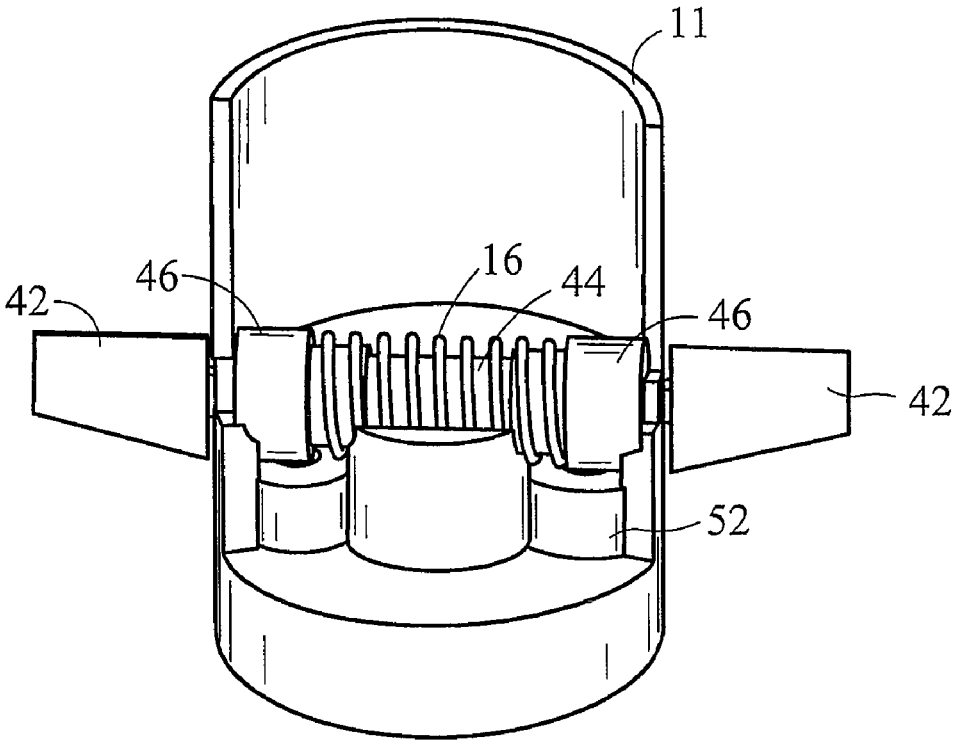
FIG. 5 illustrates the same embodiment as shown in FIG. 4 in the fully deployed position.
Figure 6:
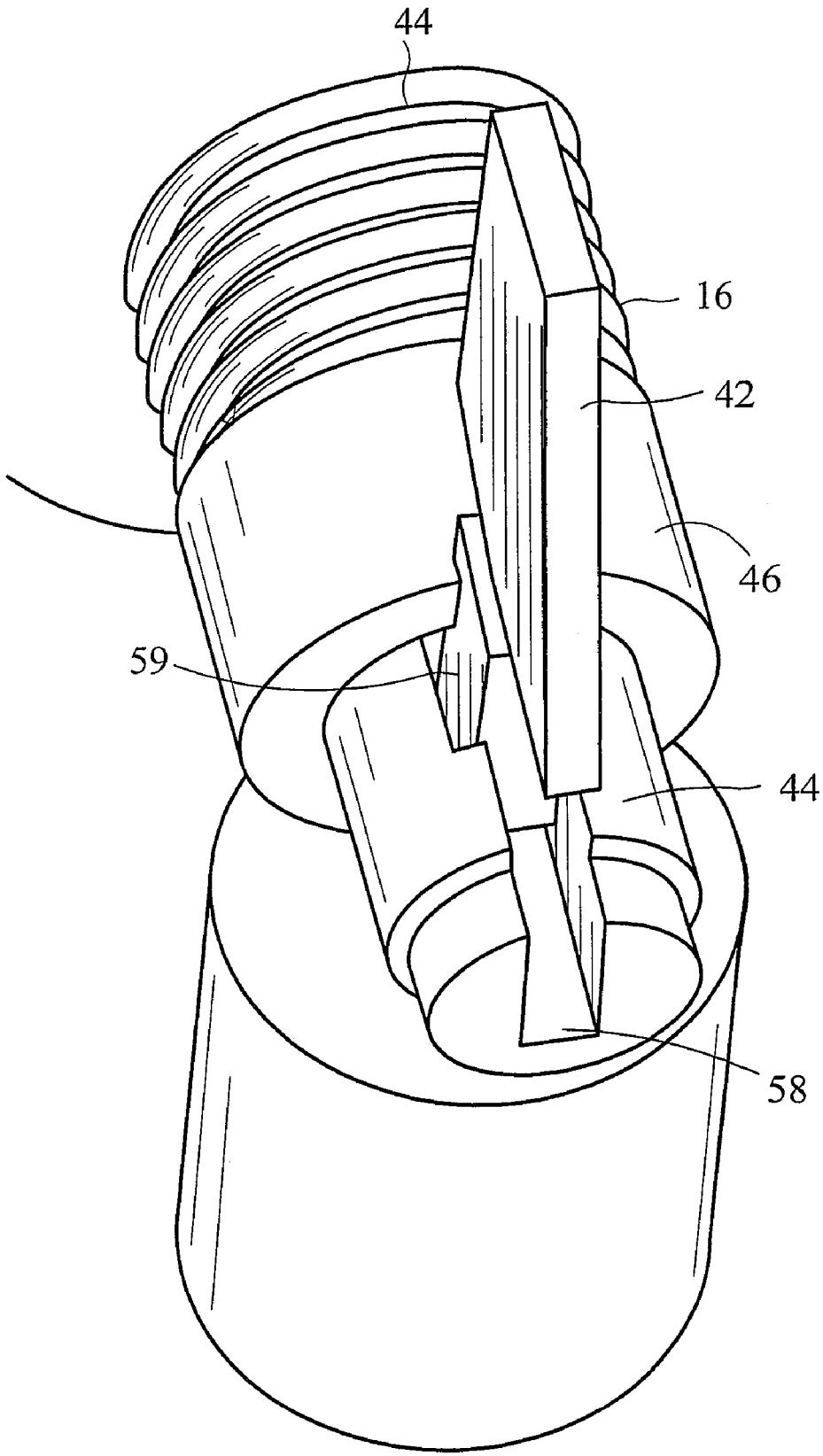
FIG. 6 illustrates a detailed view of one end of the latching mechanism of the embodiment shown in FIGS. 4 and 5.

In another embodiment, as illustrated in FIGS. 4-6, a separate sleeve 46 may be used for each fin 42. The sleeve may be any appropriate sleeve, collar, ring, or other annular structure. For example, the sleeve may be capable of sliding on a shaft 44, and each sleeve 46 may be coupled to a biasing mechanism 16 that is capable of extending the fins 42 to the fully deployed position. Again, the actuating mechanism 52 causes a rotation. In this example, the rotation is of each sleeve 46 relative to the shaft 44. Each sleeve 46 engages a portion of the fin 42. The relative rotation of the sleeve 46 to a latch 59 in the shaft 44 frees the portion of the fin 42 from the latch 59. The biasing mechanism 44 applies a force to the sleeve 46. In this example, each of the fins 42 are coupled to the shaft 44 by a pin 56, which secures the fin 42 to the shaft 44, but allows the fin 42 to rotate about the rotational axis of the pin 56. The force applied by the sleeve 46 causes the fin 42 to rotate about the axis of the pin 56 until the fin 42 extends outward from the shell 11 to a fully deployed position Again, a single biasing mechanism 16 and an elongated shaft 44 may be used to deploy fins 42 disposed on opposite sides of a projectile body, as shown in FIGS. 4 and 6. This provides the same advantages of a simple fin retention and locking mechanism, reduced part count and shaft stability, as the example illustrated by FIGS. 1-3C. The simplicity of the fin retention mechanism of these examples improves reliability and robustness of the design. The reduced part count decreases the cost of manufacture. The ability to support an elongated shaft improves the stability of the shaft and aerodynamic performance of the fins in flight, making the use of expensive bearings optional. The fins 42 are attached to the shaft 44 of their respective shaft portions, such that the fins 42 rotate with their respective portions of the shaft 44 about the axis of the respective shaft 44. For example, the fins are attached by a portion of the fins 42, such as a pin 56, that is used as a retaining member to secure the fins 42 in the latch 59. Alternatively, any other element may be used to fix the fins 42 to their respective portions of the shaft 44, and a separate element may be used to secure the fins 42 in the latched position, until rotation of the actuating mechanism 52 frees the fins 42 from the latch 59.

Alternatively, independent biasing mechanisms may be used to apply a force to drive each of the fins to the deployed position without substantially adding complexity to the system. It is not necessary to have only two fins or to have the fins deployed opposite of each other for the retention and latching mechanism of the present invention to improve performance compared to previously known deployment systems. The mere elimination of the need for separate deployment servo motors reduces cost and improves reliability of the present invention. Many variations and combinations of elements found in the examples disclosed and other structural modifications will become apparent to a person of skill in the art based on the drawings and description, and the scope of the invention is not to be limited merely to these examples.

What is claimed is:

1. A fin deployment mechanism for a guided projectile comprising:

a first fin having an aerodynamic control surface, the fin being movable from a retracted position to an extended position;

an actuator mechanism for controlling movement of the fin during flight of the projectile;

a telescoping shaft having a first end, the base of the fin being connected with the first end of the telescoping shaft;

a biasing mechanism for biasing the telescoping shaft toward the extended position; and a latch mechanism for selectively securing the telescoping shaft in the retracted position;

wherein the actuator mechanism is operable to release the latch mechanism allowing the fin to move to the extended position, and the actuator mechanism is operable to manipulate the fin for guidance of the projectile during flight, further comprising a second fin having an aerodynamic control surface;

wherein the telescoping shaft comprises:

a first tube, and a second tube fitted telescopically within the first tube;

wherein the first fin is connected with an end of the first tube and the second fin connected with an opposing end of the second tube; and wherein the biasing mechanism applies an axial, outward force between the first tube and the second tube for telescopically extending the shaft.

2. The fin deployment mechanism of claim 1, wherein the biasing mechanism is disposed within the second tube.

3. The fin deployment mechanism of claim 2, wherein the biasing mechanism is a spring.

4. The fin deployment mechanism of claim 1 wherein the actuator mechanism releases the latch mechanism by rotating either of the first tube or the second tube relative to the other of the first tube or the second tube.

5. The fin deployment mechanism of claim 4, wherein the latch mechanism comprises:

a pin attached to either of the first tube or the second tube; and a slot formed in the other of the first tube or the second tube, the slot comprising a latch portion formed at an end of the slot;

wherein the pin is positioned within the latch portion of the slot when the telescoping shaft is in the retracted position, and the biasing mechanism moves the telescoping shaft to the extended position when the pin is rotated out of the latch portion of the slot.

6. The fin deployment mechanism of claim 1, wherein the actuator mechanism comprises:

a first actuator coupled with the first tube of the telescoping shaft for control of the first fin; and a second actuator coupled with the second tube for control of the second fin.

7. The fin deployment mechanism of claim 6, wherein the first actuator comprises an electric motor, and the second actuator comprises an electric motor.

8. A fin deployment mechanism for a guided projectile comprising:

a first fin having an aerodynamic control surface, the fin being movable from a retracted position to an extended position;

an actuator mechanism for controlling movement of the fin during flight of the projectile;

a telescoping shaft having a first end, the base of the fin being connected with the first end of the telescoping shaft;

a biasing mechanism for biasing the telescoping shaft toward the extended position;

a latch mechanism for selectively securing the telescoping shaft in the retracted position; and a second fin having an aerodynamic control surface;

wherein the actuator mechanism is operable to release the latch mechanism allowing the fin to move to the extended position, and the actuator mechanism is operable to manipulate the fin for guidance of the projectile during flight, wherein the telescoping shaft comprises a first tube, and a second tube fitted telescopically within the first tube;

wherein the first fin is connected with an end of the first tube and the second fin connected with an opposing end of the second tube;

wherein the biasing mechanism applies an axial, outward force between the first tube and the second tube for telescopically extending the shaft; and wherein the biasing mechanism is disposed within the second tube.

9. The fin deployment mechanism of claim 8, wherein the biasing mechanism is a spring.

10. A fin deployment mechanism for a guided projectile comprising:

a first fin having an aerodynamic control surface, the fin being movable from a retracted position to an extended position;

an actuator mechanism for controlling movement of the fin during flight of the projectile;

a telescoping shaft having a first end, the base of the fin being connected with the first end of the telescoping shaft;

a biasing mechanism for biasing the telescoping shaft toward the extended position; and a latch mechanism for selectively securing the telescoping shaft in the retracted position; and a second fin having an aerodynamic control surface;

wherein the actuator mechanism is operable to release the latch mechanism allowing the fin to move to the extended position, and the actuator mechanism is operable to manipulate the fin for guidance of the projectile during flight;

wherein the telescoping shaft comprises a first tube, and a second tube fitted telescopically within the first tube;

wherein the first fin is connected with an end of the first tube and the second fin connected with an opposing end of the second tube;

wherein the biasing mechanism applies an axial, outward force between the first tube and the second tube for telescopically extending the shaft; and wherein the actuator mechanism releases the latch mechanism by rotating either of the first tube or the second tube relative to the other of the first tube or the second tube.

11. The fin deployment mechanism of claim 10, wherein the latch mechanism comprises:

a pin attached to either of the first tube or the second tube; and a slot formed in the other of the first tube or the second tube, the slot comprising a latch portion formed at an end of the slot;

wherein the pin is positioned within the latch portion of the slot when the telescoping shaft is in the retracted position, and the biasing mechanism moves the telescoping shaft to the extended position when the pin is rotated out of the latch portion of the slot.

12. A fin deployment mechanism for a guided projectile comprising:

a first fin having an aerodynamic control surface, the fin being movable from a retracted position to an extended position;

an actuator mechanism for controlling movement of the fin during flight of the projectile;

a telescoping shaft having a first end, the base of the fin being connected with the first end of the telescoping shaft;

a biasing mechanism for biasing the telescoping shaft toward the extended position; and a latch mechanism for selectively securing the telescoping shaft in the retracted position;

wherein the actuator mechanism is operable to release the latch mechanism allowing the fin to move to the extended position, and the actuator mechanism is operable to manipulate the fin for guidance of the projectile during flight, the fin having a lateral axis wherein the lateral axis of the fin coincides with a longitudinal axis of the shaft when the fin is in the retracted position and when the fin is in the extended position.

* * * * *

UNITED STATES PATENT AND TRADEMARK OFFICE

CERTIFICATE OF CORRECTION

PATENT NO. : 7,475,846 B2
APPLICATION NO. : 11/243323
DATED : January 13, 2009
INVENTOR(S) : Schroeder It is certified that error appears in the above-identified patent and that said Letters Patent is hereby corrected as shown below:

Column 1, line 55, after the word “walls” delete “a”.
Column 3, line 24, after the word “in” delete “FIGS.” and add --FIG.--.

Signed and Sealed this

Tenth Day of March, 2009

JOHN DOLL
*Acting Director of the United States Patent and Trademark Office*